US009951737B2

(12) United States Patent
Wagner et al.

(10) Patent No.: US 9,951,737 B2
(45) Date of Patent: Apr. 24, 2018

(54) FUEL INJECTION SYSTEM OF AN INTERNAL COMBUSTION ENGINE

(75) Inventors: Wolfgang Wagner, Dessau-Rosslau (DE); Markus Meixner, Augsburg (DE)

(73) Assignee: MAN Diesel & Turbo SE, Augsburg (DE)

( * ) Notice: Subject to any disclaimer, the term of this patent is extended or adjusted under 35 U.S.C. 154(b) by 724 days.

(21) Appl. No.: 14/002,873

(22) PCT Filed: Mar. 2, 2012

(86) PCT No.: PCT/EP2012/053664
§ 371 (c)(1),
(2), (4) Date: Dec. 10, 2013

(87) PCT Pub. No.: WO2012/119957
PCT Pub. Date: Sep. 13, 2012

(65) Prior Publication Data

US 2013/0340711 A1 Dec. 26, 2013

(30) Foreign Application Priority Data

Mar. 4, 2011 (DE) ..... 10 2011 005 096

(51) Int. Cl.
*F02M 63/02* (2006.01)
*F02M 55/02* (2006.01)

(52) U.S. Cl.
CPC ..... *F02M 63/0265* (2013.01); *F02M 55/025* (2013.01); *F02M 63/0285* (2013.01); *F02M 2200/315* (2013.01)

(58) Field of Classification Search
CPC .. F02D 41/403; F02D 41/402; F02D 41/2467; F02D 19/061; F02D 41/3845;
(Continued)

(56) References Cited

U.S. PATENT DOCUMENTS 6,145,493 A * 11/2000 Espey ..... F02M 39/00 123/456
6,601,566 B2 * 8/2003 Gillis ..... F02M 43/00 123/467
(Continued)

FOREIGN PATENT DOCUMENTS

DE 197 12 135 C1 8/1998
DE 101 14 252 A1 9/2002
(Continued)

OTHER PUBLICATIONS

Preliminary Report on Patentability with the Written Opinion (and English Translation thereof) dated Sep. 10, 2013 issued in the corresponding International Patent Application No. PCT/EP2012/053664.

*Primary Examiner* — Long T Tran
(74) *Attorney, Agent, or Firm* — Cozen O'Connor

(57) ABSTRACT

An internal combustion engine (1) has a plurality of combustion cylinders at each of which a fuel injection device (120) is provided. Every combustion cylinder is provided with its own pilot unit (10*c*-10*f*) with a fuel accumulator which is integrated therein and which is connected by one of a plurality of first fuel lines (110) to the fuel injection device associated with the respective combustion cylinder for supplying fuel to the latter. A fuel pump which can be connected to a fuel source for supplying a predetermined fuel pressure is integrated in at least one of the pilot units (10*d*). The fuel accumulator of every pilot unit is so adapted that it ensures that fuel delivered by the fuel pump is supplied to the respective associated fuel injection device in a pressure-stable manner.

9 Claims, 5 Drawing Sheets

(58) Field of Classification Search
CPC ..... F02D 19/0605; F02D 41/3809; F02D 41/3863; F02D 2041/389
USPC ..... 123/445–448, 454, 456; 239/585.1–585.5, 584, 533.2
See application file for complete search history.

(56) References Cited

U.S. PATENT DOCUMENTS

| | | | | |
|---|---|---|---|---|
| 7,509,942 | B2 * | 3/2009 | Knight | F02M 55/025 123/456 |
| 7,748,364 | B2 * | 7/2010 | Hanneke | F02M 55/025 123/447 |
| 2003/0187565 | A1 * | 10/2003 | Wong | F02D 19/027 701/103 |
| 2006/0144368 | A1 * | 7/2006 | Knight | F02M 55/025 123/447 |
| 2009/0277423 | A1 * | 11/2009 | Cooke | F02M 45/086 123/494 |
| 2010/0100303 | A1 * | 4/2010 | Yuzaki | F02D 41/062 701/103 |

FOREIGN PATENT DOCUMENTS

| | | | |
|---|---|---|---|
| DE | 101 57 135 | B4 | 6/2003 |
| DE | 10 2004 055266 | A1 | 5/2006 |
| EP | 0 959 245 | B1 | 11/1999 |
| WO | WO 2004/013487 | A1 | 2/2004 |
| WO | WO 2007/009279 | A1 | 1/2007 |

* cited by examiner

FUEL INJECTION SYSTEM OF AN INTERNAL COMBUSTION ENGINE

PRIORITY CLAIM

This is a U.S. national stage of PCT International Application No. PCT/EP2012/053664, filed on 2 Mar. 2012, which claims priority to German Application No. 10 2011 005 096.4, filed 4 Mar. 2011, the contents of which are incorporated herein by reference in their entirety.

BACKGROUND OF THE INVENTION

1. Field of the Invention

The invention is directed to an internal combustion engine having a plurality of combustion cylinders at each of which a fuel injection device is provided and having at least one fuel pump for supplying a predetermined fuel pressure. An internal combustion engine of the type mentioned above can be outfitted with a common rail fuel system whose components comprise a fuel pump, fuel pressure accumulator or fuel accumulator, fuel injection devices or fuel injectors, and fuel lines.

2. Description of the Related Art

In some internal combustion engines, particularly in medium-speed diesel engines, it is useful for reasons pertaining to design, manufacture and logistics to divide the fuel accumulator into a plurality of small fuel accumulators instead of providing a single fuel accumulator along the entire length of the engine and connecting this plurality of fuel accumulators to one another by means of fuel lines. The fuel pressure can be generated by a plurality of fuel pumps (e.g., high-pressure pumps) arranged on a pump bank.

Internal combustion engines with a common rail fuel system are described in DE 101 57 135 B4 and EP 0 959 245 B1. In these internal combustion engines, principally two combustion cylinders are supplied with fuel from a fuel pressure accumulator. Thus, when there is an odd number of cylinders a fuel pressure accumulator must be provided for supplying fuel to only one individual combustion cylinder. Further, since these common rail fuel systems are formed of a plurality of separate (high-pressure) fuel pumps and fuel pressure accumulators, they require a large number of fuel lines which are designed for high pressure and which have different deflection curves and lengths, which increases production costs and makes it more difficult to provide replacement parts.

In view of the fact that the fuel pumps in the common rail fuel systems described in the above-cited documents deliver fuel into the fuel pressure accumulators via one or two fuel lines designed for high pressure, each fuel line itself represents a choke point. This leads to high pressure peaks in the fuel pump connected thereto. Accordingly, the risk of overloading of component parts and leakiness at high-pressure seals increases. The intermittent delivery of the fuel pumps leads to a massive excitation of vibrations in the fuel lines leading from the fuel pumps. This increases the risk of line breakage due to fretting or friction wear at the fastening points as a result of the high vibrational stress.

SUMMARY OF THE INVENTION

It is an object of the invention to provide an internal combustion engine having a plurality of combustion cylinders at each of which a fuel injection device is provided and having at least one fuel pump for supplying a predetermined fuel pressure such that pressure peaks in the fuel pump and excitation of vibrations are reduced or minimized.

This and other objects and advantages are achieved in accordance with the invention by providing an internal combustion engine having a plurality of combustion cylinders at each of which a fuel injection device is provided, wherein every combustion cylinder is provided with its own pilot unit with a fuel accumulator which is integrated therein and which is connected preferably directly (without the intermediary of further components) by one of a plurality of first fuel lines to the fuel injection device associated with the respective combustion cylinder for supplying fuel to the latter. A fuel pump which can be connected to a fuel source for supplying a predetermined fuel pressure is integrated in at least one of the pilot units and delivers fuel immediately or directly into the fuel accumulator of the respective pilot unit. The fuel accumulator of every pilot unit is so adapted that it ensures that fuel delivered by the fuel pump is supplied to the respective associated fuel injection device in a pressure-stable manner (in conformity with a specified injection pressure tolerance), and wherein the respective fuel accumulators of the pilot units are connected to one another preferably directly (without the intermediary of further components) via a plurality of second fuel lines.

Pressure peaks in the fuel pump and excitation of vibrations in the fuel lines are appreciably reduced or minimized in that for every pilot unit formed with integrated fuel pump the fuel is conveyed directly or immediately into the fuel accumulator (pressure accumulator) of the respective pilot unit.

The fuel accumulators preferably have an accumulator chamber having a volume which affords a sufficient buffer amount and, therefore, sufficient buffer pressure relative to the fuel decrease through the respective connected fuel injection device to ensure a pressure-stable fuel supply.

The internal combustion engine is preferably constructed as a diesel engine, particularly as a large diesel engine, e.g., for maritime applications and/or power plant applications. Further, every fuel pump is preferably constructed as a high-pressure pump, and the first fuel lines and second fuel lines are preferably designed for high pressure and are constructed, e.g., as pressure tubes.

As will be clear to the person skilled in the art, the pilot units, the first fuel lines, second fuel lines and the fuel injection devices form a common rail fuel injection system for the internal combustion engine according to the invention.

In accordance with an aspect of the invention, an internal combustion engine with a modularly constructed common rail fuel injection system is provided so as to allow the system to be adapted in an optimal manner to the cylinder-dependent engine design, particularly of medium-speed diesel engines. The central elements are the pilot units with a fuel accumulator or pressure accumulator, which is integrated therein and which causes a damping of pressure vibrations in the fuel system to which high pressure is preferably applied and a fuel pump additionally integrated in at least one pilot unit.

In accordance with an aspect of the invention, the pilot units can be designed such that they realize various other functions apart from that of pressure accumulator. For example, pilot units or function units of this kind can be constructed with fuel accumulator and high-pressure pump, with fuel accumulator and pressure limiting valve, with fuel accumulator and purge valve, with fuel accumulator and pressure measuring locations, with fuel accumulator and quantity limiting valve, or only with fuel accumulator and without additional function elements.

It is also possible according to the invention to combine a plurality of functions in one pilot unit, e.g., purge valve and pressure limiting valve.

It is also possible according to the invention to integrate a switching unit for controlling injection at each pilot unit.

In accordance with an aspect of the invention, these pilot units or function units are arranged at the internal combustion engine in front of every combustion cylinder or every cylinder unit. Since basically any type of pilot unit can be placed in front of every combustion cylinder, an optimal construction of the common rail fuel injection system can be realized for any number of cylinders based on identical or virtually identical pilot units. Therefore, for example, the pilot units which are provided integral with fuel accumulators and high-pressure pumps can be arranged such that an optimal functioning of the entire system is achieved corresponding to the hydraulic design.

For technical reasons relating to function, in internal combustion engines suitable for heavy oil (diesel engines) it is preferable according to the invention that a pilot unit which is provided integral with fuel accumulator and purge valve be placed in front of a first combustion cylinder or a last combustion cylinder in a series of cylinders or in a fuel delivery flow.

In accordance with another aspect of the invention, the pilot units are connected to one another by means of the second fuel lines which are preferably formed as pressure tubes. Further, according to the invention, the connection between pilot unit and fuel injection device is carried out by means of the first fuel lines, which are preferably formed as pressure tubes. Accordingly, any number of cylinders is covered by only two pressure tube constructions. The construction of the system allows the use of fuel lines which are bent in a plane and which are advantageous with respect to vibration and manufacture.

In accordance with another aspect of the invention, a fuel pump, which can be connected to the fuel source and which delivers the fuel immediately or directly into the fuel accumulator of the respective pilot unit, is preferably integrated in a plurality of the pilot units.

In accordance with another aspect of the invention, a quantity limiting valve for limiting a quantity of fuel to be supplied per time unit to the associated fuel injection device is preferably integrated in at least one of the pilot units.

In another aspect, a quantity limiting valve for limiting a quantity of fuel to be supplied per time unit to the associated fuel injection device is preferably integrated in at least one pilot unit with integrated fuel pump.

In another aspect, a pressure limiting valve for limiting the fuel pressure is preferably integrated in at least one of the pilot units.

In accordance with another aspect of the invention, a quantity limiting valve for limiting a quantity of fuel to be supplied per time unit to the associated fuel injection device and a pressure limiting valve for limiting the fuel pressure are preferably integrated in at least one of the pilot units.

In accordance with another aspect of the invention, at least some of the combustion cylinders are preferably arranged in a row relative to one another, wherein a purge valve is integrated in the pilot unit of a combustion cylinder forming a front end or a rear end of the row of combustion cylinders.

In another aspect, a pressure limiting valve for limiting the fuel pressure is preferably integrated in the pilot unit with integrated purge valve.

In another aspect, at least one pressure measuring location for connecting at least one fuel pressure sensor is preferably integrated in at least one of the pilot units for measuring the fuel pressure in the fuel accumulator of the respective pilot unit.

In another aspect, the first fuel lines are preferably all constructed so as to be identical to one another (identical material, identical shape, identical cross section and identical length), wherein, further, the second fuel lines are all constructed so as to be identical to one another.

The invention also expressly extends to embodiment forms which are not given by combinations of features from explicit references of the claims so that the disclosed features of the invention can be combined with one another in any way insofar as technically meaningful.

BRIEF DESCRIPTION OF THE DRAWINGS

In the following, the invention will be described in more detail with reference to a preferred embodiment and the accompanying figures. In the drawings.

DETAILED DESCRIPTION OF THE PREFERRED EMBODIMENTS

Figure 1:
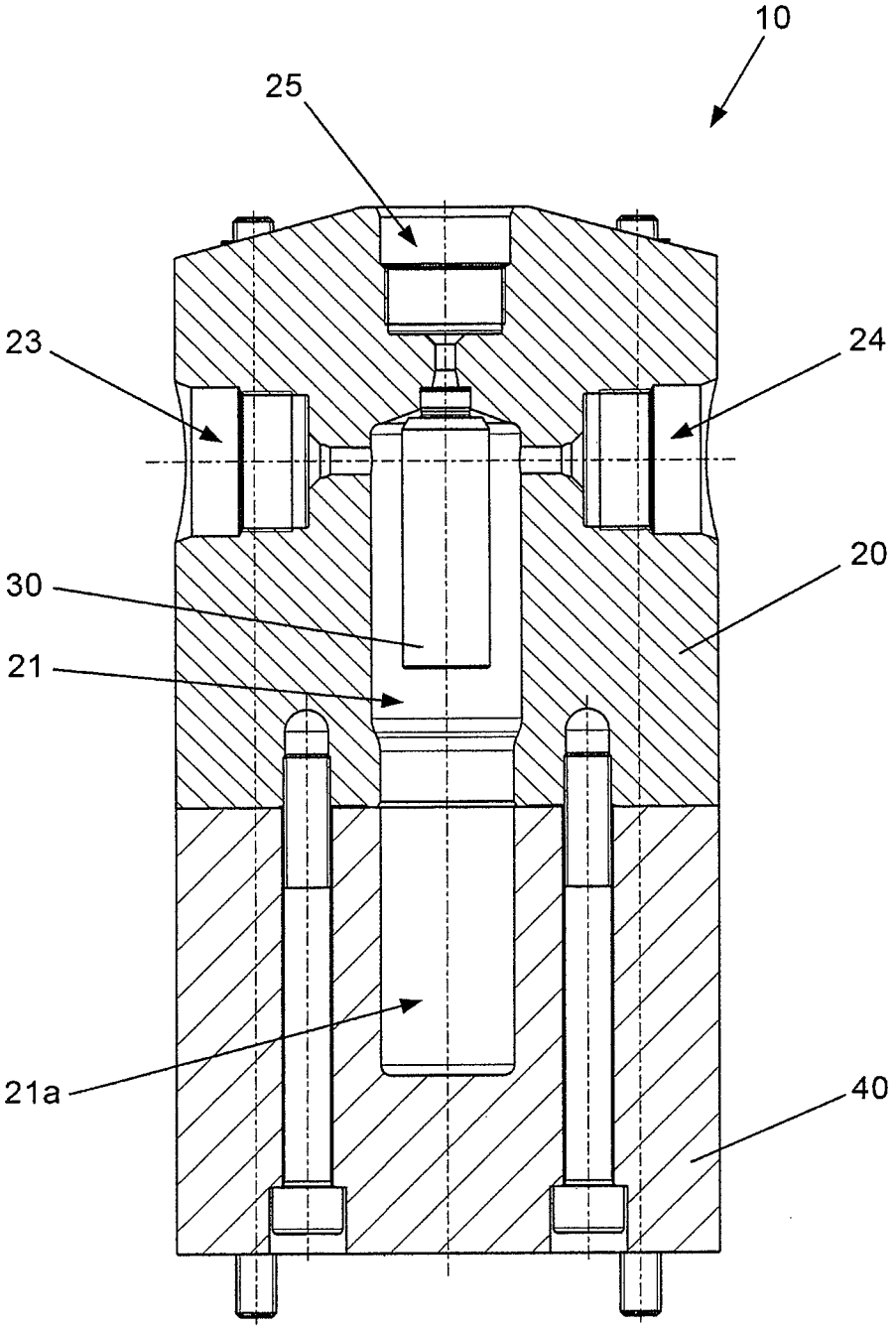
FIG. 1 is a sectional view of a construction of the pilot units of an internal combustion engine according to an embodiment of the invention.
Figure 4:
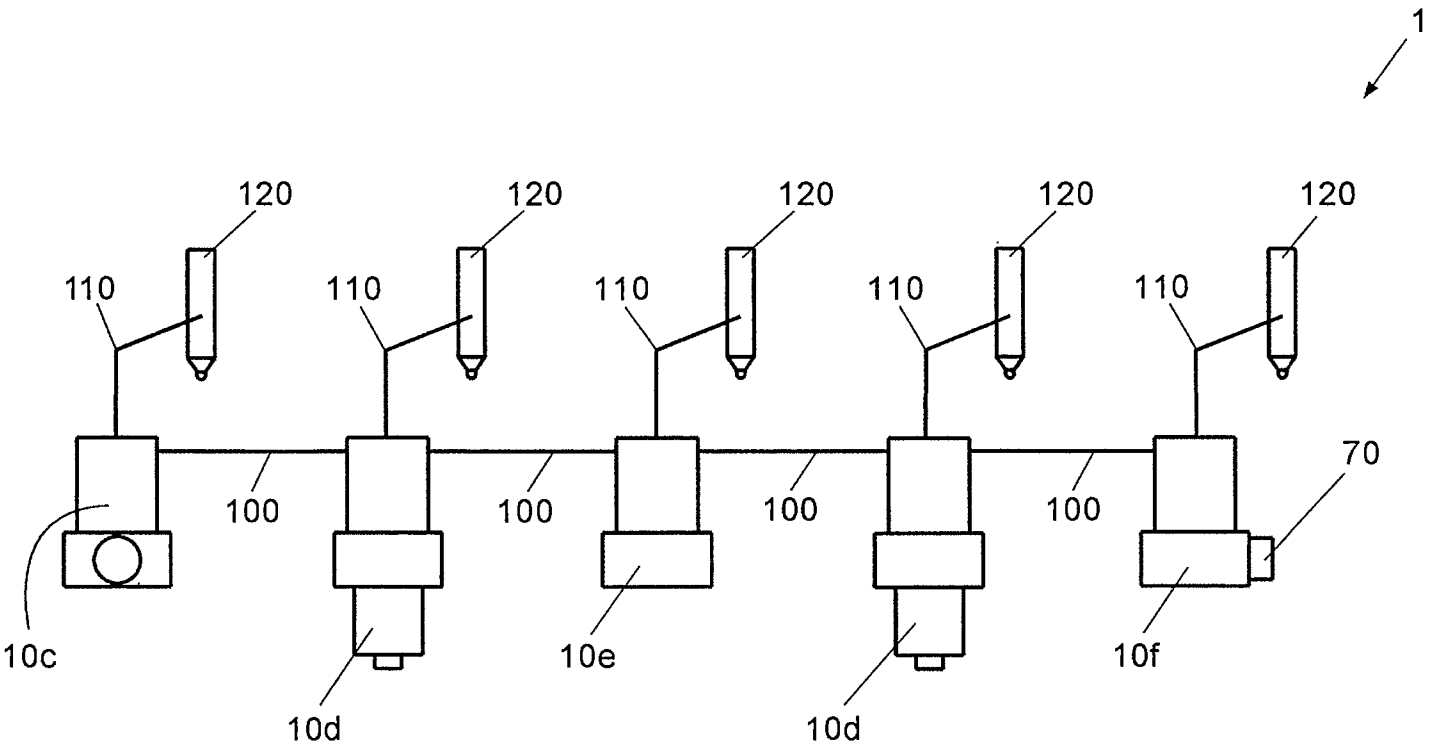
FIG. 4 is a schematic partial view of an internal combustion engine with associated pilot units according to an embodiment of the invention.
Figure 5:
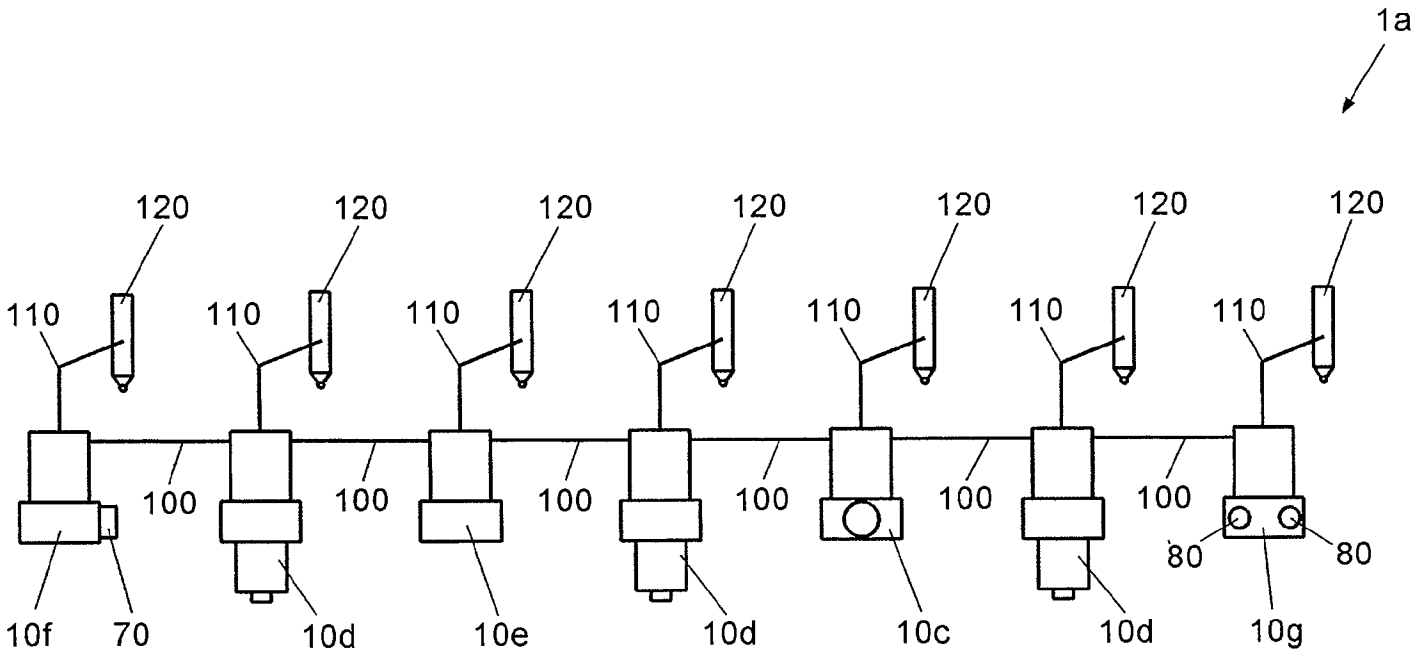
FIG. 5 is a schematic partial view of an internal combustion engine with associated pilot units according to yet another embodiment of the invention.

FIG. 1 shows a pilot unit or function unit 10 in a first embodiment of the invention for an internal combustion engine 1 or 1*a* (see FIGS. 4 and 5).

A fuel accumulator (pressure accumulator) 20 with an accumulator chamber 21 and a quantity limiting valve 30, which protects the internal combustion engine 1 or 1*a* from an uncontrolled injection, are integrated in the pilot unit 10. The pilot unit 10 further has a cover 40 in which, according to this embodiment, a partial chamber 21*a* of the accumulator chamber 21 is formed as chamber expansion and which closes the fuel accumulator 20 and the accumulator chamber 21 thereof.

Two line connections 23, 24 for two fuel lines 100, 100 (see FIGS. 3 and 4) to adjacent pilot units are located at the fuel accumulator 20, these two line connections 23, 24 being connected to the accumulator chamber 21. Further, another line connection 25, which is connected (by the quantity limiting valve 30) to the accumulator chamber 21, is located at the fuel accumulator 20 for a fuel line 110 (see FIGS. 4 and 5) to a fuel injection device 120 which is directly connected to the pilot unit 10 and which in this case is constructed as an injector or an injection nozzle.

Figure 2:
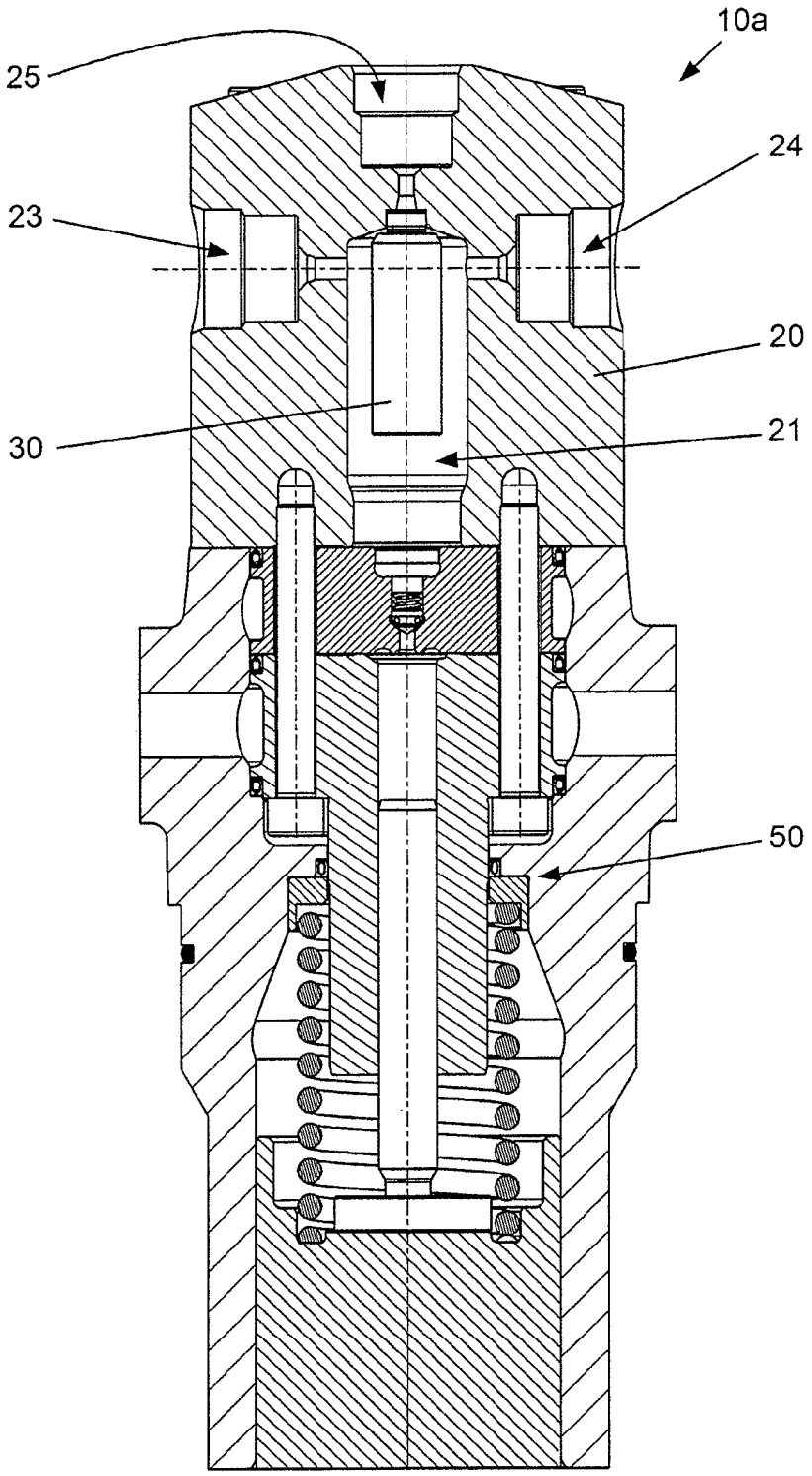
FIG. 2 is a sectional view of another construction of the pilot units of an internal combustion engine according to an embodiment of the invention.

FIG. 2 shows a pilot unit or function unit 10*a* constructed according to a second embodiment of the invention for the internal combustion engine 1 or 1*a* (see FIGS. 4 and 5). The pilot unit 10*a* according to FIG. 2 is constructed identical to the pilot unit 10 according to FIG. 1 with a few exceptions.

Therefore, components in FIG. 2 that are identical to or similar to components in FIG. 1 are designated by identical or similar reference numerals.

A fuel accumulator (pressure accumulator) 20 with an accumulator chamber 21, a quantity limiting valve 30, which protects the internal combustion engine 1 or 1*a* from an uncontrolled injection, and a fuel pump 50, which can be connected to a fuel source such as a fuel tank (not shown) for supplying a predetermined fuel pressure, are integrated in the pilot unit 10*a*. The fuel pump 50 is connected to the fuel accumulator 20 by flanging such that it can deliver fuel directly or immediately to the accumulator chamber 21 of the fuel accumulator 20 and (instead of the cover 40) closes the fuel accumulator 20 and the accumulator chamber 21 thereof. Therefore, no additional fuel line (e.g., in the form of a pressure tube) is required for connecting the fuel pump 50 and accumulator chamber 21 of the fuel accumulator 20.

Two line connections 23, 24 for two fuel lines 100, 100 (see FIGS. 3 and 4) to adjacent pilot units are located at the fuel accumulator 20, these two line connections 23, 24 being connected to the accumulator chamber 21. Further, another line connection 25, which is connected (by the quantity limiting valve 30) to the accumulator chamber 21, is located at the fuel accumulator 20 for a fuel line 110 (see FIGS. 4 and 5) to a fuel injection device 120, which is directly connected to the pilot unit 10*a* and which in this case is constructed as an injector or an injection nozzle.

Figure 3:
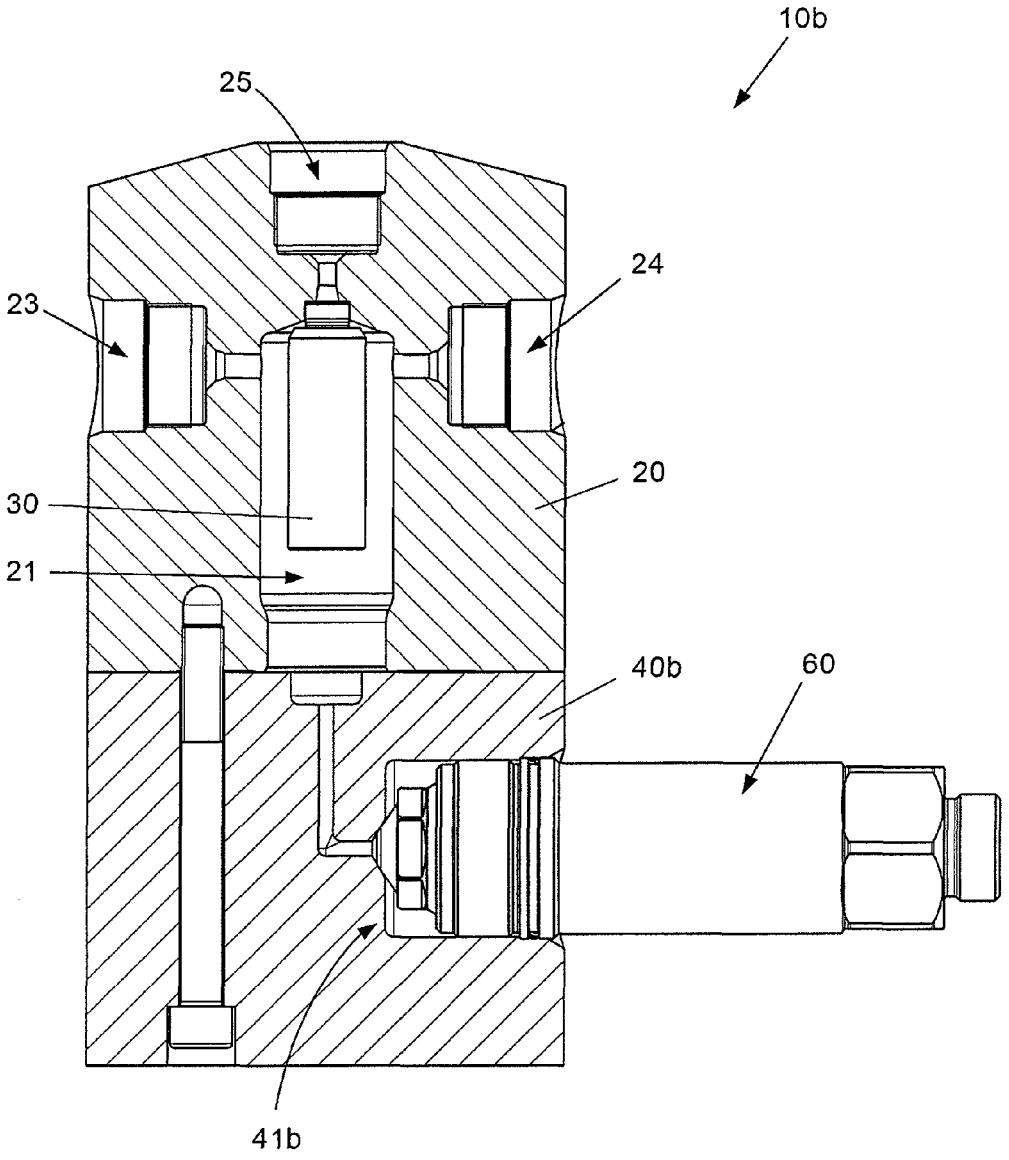
FIG. 3 is a sectional view of yet another construction of the pilot units of an internal combustion engine according to an embodiment of the invention.

FIG. 3 shows a pilot unit or function unit 10*b* constructed according to a third embodiment of the invention for the internal combustion engine 1 or 1*a* (see FIGS. 4 and 5). The pilot unit 10*b* according to FIG. 3 is constructed identical to the pilot unit 10 according to FIG. 1 with a few exceptions. Therefore, components in FIG. 3 that are identical to or similar to components in FIG. 1 are designated by identical or similar reference numerals.

A fuel accumulator (pressure accumulator) 20 with an accumulator chamber 21, a quantity limiting valve 30, which protects the internal combustion engine 1 or 1*a* from an uncontrolled injection, and a pressure limiting valve 60 for limiting the fuel pressure are integrated in the pilot unit 10*b*. The pilot unit 10*b* further has a cover 40*b* in which is formed a connection 41*b* for the pressure limiting valve 60, which connection 41*b* is connected to the accumulator chamber 21 and closes the fuel accumulator 20 and the accumulator chamber 21 thereof.

Two line connections 23, 24 for two fuel lines 100, 100 (see FIGS. 3 and 4) to adjacent pilot units are located at the fuel accumulator 20, these two line connections 23, 24 being connected to the accumulator chamber 21. Further, another line connection 25, which is connected (by the quantity limiting valve 30) to the accumulator chamber 21, is located at the fuel accumulator 20 for a fuel line 110 (see FIGS. 4 and 5) to a fuel injection device 120, which is directly connected to the pilot unit 10*a* and which in this case is constructed as an injector or an injection nozzle.

FIG. 4 shows a schematic partial view of an internal combustion engine 1 with associated pilot units according to an embodiment of the invention.

The internal combustion engine 1 shown in FIG. 4 has further embodiment forms of pilot units which will be described briefly in the following and which can be used as an alternative to or in addition to the pilot units 10, 10*a*, 10*b* described with reference to FIGS. 1 to 3.

The first pilot unit 10*c* on the left-hand side of FIG. 4 is similar to the pilot unit 10*b* of FIG. 3 but can be constructed without a quantity limiting valve 30. The second pilot unit 10*d* from the left in FIG. 4 (which is the same as the second pilot unit 10*d* from right) is constructed similarly to pilot unit 10*a* of FIG. 2 but can be constructed without a quantity limiting valve 30. The middle pilot unit 10*e* in FIG. 4 is constructed similarly to pilot unit 10 of FIG. 1 but can be constructed without a quantity limiting valve 30. The first pilot unit 10*f* on the right-hand side in FIG. 4 is constructed similarly to the pilot unit 10*b* of FIG. 3 but has a purge valve 70 instead of the pressure limiting valve 60 and can be constructed without a quantity limiting valve 30.

The internal combustion engine 1 has a plurality of (five in the present case) combustion cylinders (not shown in detail and therefore not designated separately) at each of which a fuel injection device 120 is provided.

Each combustion cylinder is provided with its own pilot unit 10*c*, 10*d*, 10*e*, 10*f* (or, if desired, additionally or alternatively with one of the pilot units 10, 10*a*, 10*b* shown in FIGS. 1 to 3) with a fuel accumulator 20 integrated therein, wherein the fuel accumulator 20 is directly connected by a fuel line 110 via the front line connection 25 (see FIGS. 1 to 3) to the fuel injection device 120 associated with the respective combustion cylinder for supplying fuel to the latter.

According to the invention, a fuel pump 50 (see FIG. 2), which can be connected to a fuel source (such as a fuel tank, not shown) for supplying a predetermined fuel pressure, is integrated in at least one of the pilot units 10*c*, 10*d*, 10*e*, 10*f* (in two of the pilot units 10*d* in the present case).

The fuel accumulator 20 of each of the pilot units 10*c*, 10*d*, 10*e*, 10*f* shown in FIGS. 1 to 4 is adapted in such a way that it ensures a pressure-stable supply of the respective associated fuel injection device 120 with fuel that is delivered by the fuel pump(s) 50.

The respective fuel accumulators 20 of the pilot units 10*c*, 10*d*, 10*e*, 10*f* shown in FIG. 4 (or, if desired, additionally or alternatively of the pilot units 10, 10*a*, 10*b* shown in FIGS. 1 to 3) are directly connected to one another by their lateral line connections 23, 24 (see FIGS. 1 to 3) and by a plurality of fuel lines 100.

The internal combustion engine 1 is preferably designed as a diesel engine suitable for heavy oil, particularly as a large diesel engine, e.g., for maritime applications and/or power plant applications. Further, every fuel pump 50 is preferably designed as a high-pressure pump and all fuel lines 100, 110 are preferably designed for high pressure and, e.g., constructed as pressure tubes.

As can be seen from FIG. 4, the fuel lines 110 forming the connection between pilot units 10*c*, 10*d*, 10*e*, 10*f* and fuel injection devices 120 are all constructed identically and the fuel lines 100 forming the connection between adjacent pilot units 10*c*, 10*d*, 10*e*, 10*f* are also all constructed identically.

FIG. 5 shows a schematic partial view of an internal combustion engine 1*a* with associated pilot units according to a further embodiment of the invention.

The internal combustion engine 1*a* shown in FIG. 5 has another embodiment of a pilot unit which will be described briefly in the following and which can be used in addition to the pilot units 10, 10*a*, 10*b*, 10*c*, 10*d*, 10*f* described with reference to FIGS. 1 to 4.

The first pilot unit 10*g* on the right-hand side in FIG. 5 is constructed similarly to the middle pilot unit 10*e* in FIG. 4 but additionally has two pressure measuring locations 80, 80 integrated therein for connecting fuel pressure sensors (not shown) for measuring the fuel pressure in the fuel accumulator 20 of the pilot unit 10*g* in question.

The internal combustion engine 1*a* according to FIG. 5 is constructed identical to the internal combustion engine 1 according to FIG. 4 except for some differences. Accordingly, components that are identical to or similar to components in FIG. 4 are designated by identical or similar reference numerals in FIG. 5.

The first pilot unit 10*f* on the left-hand side in FIG. 5 is constructed similarly to the pilot unit 10*b* in FIG. 3 but has the purge valve 70 instead of the pressure limiting valve 60 and can be constructed without a quantity limiting valve 30. The second pilot unit 10*d* from left in FIG. 5 (also the middle and the second pilot unit 10*d* from right) is constructed similarly to the pilot unit 10*a* of FIG. 2 but can be constructed without quantity limiting valve 30. The third pilot unit 10*e* on the left-hand side in FIG. 5 is constructed similarly to pilot unit 10 of FIG. 1 but can be constructed without quantity limiting valve 30. The third pilot unit 10*c* from the right in FIG. 5 is constructed similarly to the pilot unit 10*b* of FIG. 3 but can be constructed without quantity limiting valve 30.

The internal combustion engine 1*a* has a plurality of (seven in the present case) combustion cylinders (not shown in detail and therefore not designated separately) at each of which a fuel injection device 120 is provided.

Each combustion cylinder is provided with its own pilot unit 10*c*, 10*d*, 10*e*, 10*f*, 10*g* (or, if desired, additionally or alternatively with one of pilot units 10, 10*a*, 10*b* shown in FIGS. 1 to 3) with fuel accumulator 20 integrated therein, wherein the fuel accumulator 20 is directly connected by a fuel line 110 via the front line connection 25 (see FIGS. 1 to 3) to the fuel injection device 120 associated with the respective combustion cylinder for supplying fuel to the latter.

A fuel pump 50 (see FIG. 2), which can be connected to a fuel source (such as a fuel tank, not shown) for supplying a predetermined fuel pressure, is integrated in at least one of the pilot units 10*c*, 10*d*, 10*e*, 10*f*, 10*g* (in three of the pilot units 10*d* in the present case).

Analogous to FIG. 4, the fuel accumulator 20 of each of the pilot units 10*c*, 10*d*, 10*e*, 10*f*, 10*g* shown in FIG. 5 is adapted such that it ensures a pressure-stable supply of the respective associated fuel injection device 120 with fuel that is delivered by the fuel pump(s) 50.

The respective fuel accumulators 20 of the pilot units 10*c*, 10*d*, 10*e*, 10*f*, 10*g* shown in FIG. 5 (or, if desired, additionally or alternatively of the pilot units 10, 10*a*, 10*b* shown in FIGS. 1 to 3) are directly connected to one another by their lateral line connections 23, 24 (see FIGS. 1 to 3) and by a plurality of fuel lines 100.

The internal combustion engine 1*a* is preferably designed as a diesel engine suitable for heavy oil, particularly as a large diesel engine, e.g., for maritime applications and/or power plant applications. Further, every fuel pump 50 is preferably designed as a high-pressure pump and all fuel lines 100, 110 are preferably designed for high pressure and, e.g., constructed as pressure tubes.

As can be seen from FIG. 5, the fuel lines 110 forming the connection between pilot units 10*c*, 10*d*, 10*e*, 10*f*, 10*g* and fuel injection devices 120 are all constructed identically and the fuel lines 100 forming the connection between adjacent pilot units 10*c*, 10*d*, 10*e*, 10*f*, 10*g* are also all constructed identically.

With respect to the function of a pressure limiting valve, a quantity limiting valve, a purge valve, a fuel accumulator and a fuel pump or high-pressure pump in the common rail fuel injection system, reference is had in addition, e.g., to DE 101 57 135 B4 from which further particulars respecting the latter can be gathered if necessary.

In summary, a quantity limiting valve 30 for limiting an amount of fuel that can be supplied to the associated fuel injection device per unit of time can be integrated according to embodiments of the invention in at least one of the pilot units 10, 10*a*, 10*b*, 10*c*, 10*d*, 10*e*, 10*f*, 10*g*. Further, a quantity limiting valve 30 for limiting an amount of fuel that can be supplied to the associated fuel injection device 120 per unit of time can be integrated in a pilot unit 10*d*. Further, a pressure limiting valve 60 for limiting the fuel pressure can be integrated in at least one of the pilot units 10*b*, 10*c*. Further, a quantity limiting valve 30 for limiting an amount of fuel that can be supplied to the associated fuel injection device 120 per unit of time and a pressure limiting valve 60 for limiting the fuel pressure can be integrated in at least one of the pilot units 10*b*.

As can be seen from FIGS. 4 and 5, at least some of the combustion cylinders can be arranged in a row relative to one another, wherein a purge valve 70 can be integrated in the pilot unit 10*f* of a combustion cylinder forming an end of the row of combustion cylinders. Further, a pressure limiting valve 60 for limiting the fuel pressure can be integrated in the pilot unit 10*f* with integrated purge valve 70.

Further, at least one pressure measuring location 80 for connecting at least one fuel pressure sensor for measuring the fuel pressure in the fuel accumulator 20 of the respective pilot unit 10*g* can be integrated in at least one of the pilot units 10*g*.

Finally, it should be noted that the pilot units or function units can be arranged in any desired or required sequence so that the common rail fuel injection system can be assembled for any quantity of cylinders in an optimal manner corresponding to requirements respecting design, technology and hydraulics.

The invention claimed is:

1. An internal combustion engine (1, 1*a*) comprising:

a plurality of combustion cylinders each of which having an associated fuel injection device (120), each of the plurality of combustion cylinders being provided with its own pilot unit (10, 10*a*-10*g*) having a fuel accumulator (20) integrated therein, each fuel accumulator (20) being connected by one of a plurality of first fuel lines (110) to the fuel injection device (120) associated with the respective combustion cylinder for supplying fuel to the respective combustion cylinder; and a fuel pump (50) configured to be connectable to a fuel source for supplying a predetermined fuel pressure, the fuel pump (50) being integrated in each instance of the plurality of the pilot units (10, 10*a*-10*g*), wherein the fuel accumulator (20) of each pilot unit (10, 10*a*-10*g*) is configured to ensure that fuel delivered by the fuel pump (50) is supplied to the respective associated fuel injection device (120) in a pressure-stable manner, and wherein the respective fuel accumulators (20) of the pilot units (10, 10*a*-10*g*) are connected to one another via a plurality of second fuel lines (100).

2. The internal combustion engine (1, 1*a*) according to claim 1, further comprising a quantity limiting valve (30) for limiting a quantity of fuel to be supplied per time unit to an associated fuel injection device (120), the quantity limiting valve (30) being integrated in at least one of the pilot units (10, 10*a*-10*g*).

3. The internal combustion engine (1, 1*a*) according to claim 1, further comprising a quantity limiting valve (30) for limiting a quantity of fuel to be supplied per time unit to an associated fuel injection device (120), the quantity limiting valve (30) being integrated in at least one pilot unit (10*d*) that has an integrated fuel pump (50).

4. The internal combustion engine (1, 1*a*) according to claim 1, further comprising a pressure limiting valve (60) for limiting the fuel pressure, the pressure limiting valve (60) being integrated in at least one of the pilot units (10*b*, 10*c*).

5. The internal combustion engine (1, 1*a*) according to claim 1, further comprising a quantity limiting valve (30) for limiting a quantity of fuel to be supplied per time unit to an associated fuel injection device (120) and a pressure limiting valve (60) for limiting the fuel pressure, wherein the quantity limiting valve (30) and the pressure limiting valve (60) are integrated in at least one of the pilot units (10*b*).

6. The internal combustion engine (1, 1*a*) according to claim 1, wherein at least some of the combustion cylinders are arranged in a row relative to one another, and the internal combustion engine (1, 1*a*) further comprises a purge valve (70) integrated in the pilot unit (10*f*) of a combustion cylinder forming an end of the row of combustion cylinders.

7. The internal combustion engine (1, 1*a*) according to claim 6, further comprising a pressure limiting valve (60) for limiting the fuel pressure, the pressure limiting valve being integrated in the pilot unit (10*f*) with the purge valve (70) integrated therein.

8. The internal combustion engine (1, 1*a*) according to claim 1, further comprising at least one pressure measuring location (80), for connecting at least one fuel pressure sensor for measuring the fuel pressure in the fuel accumulator (20) of the respective pilot unit (10*g*), the at least one pressure measuring location being integrated in at least one of the pilot units (10*g*).

9. The internal combustion engine (1, 1*a*) according to claim 1, wherein the first fuel lines (110) are all constructed so as to be identical to one another, and wherein the second fuel lines (100) are all constructed so as to be identical to one another.

* * * * *